US008191364B2

(12) United States Patent
Shimada et al.

(10) Patent No.: US 8,191,364 B2
(45) Date of Patent: Jun. 5, 2012

(54) METHOD FOR CONTROLLING PUMP OF WORKING MACHINE

(75) Inventors: Yoshiyuki Shimada, Tokyo (JP); Tetsuya Yoshino, Tokyo (JP); Nobuhiro Miki, Tokyo (JP); Yuya Kanenawa, Tokyo (JP); Yutaka Yokoyama, Tokyo (JP); Takayasu Kitai, Tokyo (JP)

(73) Assignee: Caterpillar S.A.R.L., Geneva (CH)

( * ) Notice: Subject to any disclaimer, the term of this patent is extended or adjusted under 35 U.S.C. 154(b) by 781 days.

(21) Appl. No.: 12/227,801

(22) PCT Filed: Jun. 19, 2007

(86) PCT No.: PCT/JP2007/064218

§ 371 (c)(1),
(2), (4) Date: Nov. 26, 2008

(87) PCT Pub. No.: WO2008/010536

PCT Pub. Date: Jan. 24, 2008

(65) Prior Publication Data

US 2009/0202365 A1 Aug. 13, 2009

(30) Foreign Application Priority Data

Jul. 21, 2006 (JP) ..... 2006-199512
Dec. 21, 2006 (JP) ..... 2006-344524

(51) Int. Cl.
*E02F 9/22* (2006.01)
*F15B 11/00* (2006.01)

(52) U.S. Cl. ..... 60/452; 60/494

(58) Field of Classification Search ..... 60/445, 60/452, 468, 494
See application file for complete search history.

(56) References Cited

U.S. PATENT DOCUMENTS

| | | | | |
|---|---|---|---|---|
| 4,976,106 | A | 12/1990 | Noerskau et al. | |
| 5,799,485 | A * | 9/1998 | Sandau | 60/452 |
| 6,048,177 | A | 4/2000 | Erkkilae et al. | |
| 6,820,355 | B2 * | 11/2004 | Yoshino et al. | 60/452 |

FOREIGN PATENT DOCUMENTS

| | | | |
|---|---|---|---|
| DE | 19538649 | A1 | 4/1997 |
| JP | 58-193906 | A | 11/1983 |
| JP | 1-250602 | A | 10/1989 |
| JP | 02-047252 | U | 3/1990 |
| JP | 04-171301 | A | 6/1992 |
| JP | 06081375 | A | 3/1994 |
| JP | 06-037604 | U | 5/1994 |
| JP | 06-84005 | U | 12/1994 |
| JP | 8-338048 | A | 12/1996 |
| JP | 9-132927 | A | 5/1997 |
| JP | 09132927 | A * | 5/1997 |
| JP | 10-018357 | A | 1/1998 |

(Continued)

*Primary Examiner* — Thomas E Lazo
(74) *Attorney, Agent, or Firm* — Jacobson Holman PLLC

(57) ABSTRACT

The present invention is intended to provide a technology that can utilize the advantages of both a load sensing control and a regeneration circuit without causing any problem.

A regeneration circuit is added to a hydraulic circuit provided with a hydraulic pressure signal line for detecting a hydraulic pressure value of a circuit and controlling a volume of hydraulic fluid to a cylinder 1 with reference to the detected value. A pressure reducing valve 6 that outputs a reduced pressure as an operating signal to a pump 2, and subsequently the controlling means 5 causes the pressure reducing valve 6 to output a pressure reduction command to a pump 2 and thus to reduce a discharge rate from the pump 2, when the regeneration circuit is in a regeneration state.

2 Claims, 3 Drawing Sheets

FOREIGN PATENT DOCUMENTS

| | | | |
|---|---|---|---|
| JP | 2006-9888 | A | 1/2006 |
| JP | 2006-84005 | A | 3/2006 |
| JP | 3909356 | B2 | 4/2007 |
| JP | 2007-170485 | A | 7/2007 |

* cited by examiner

METHOD FOR CONTROLLING PUMP OF WORKING MACHINE

This is a national stage of PCT/JP2007/064218 filed Jul. 19, 2007 and published in Japanese, which has the priority of Japanese No. 2006-199512 filed Jul. 21, 2006 and Japanese No. 2006-344524 filed Dec. 21, 2006, hereby incorporated by reference.

TECHNICAL FIELD

The present invention relates to a method of controlling a pump for a working machine.

BACKGROUND ART

A load sensing circuit is adopted as a hydraulic circuit of a working machine. The load sensing circuit is intended to supply a hydraulic fluid to a cylinder in full measure in a circuit, the circuit measuring not only operating lever positions but also volumes of hydraulic pressure in the circuit, and thereafter calculating a cylinder load pressure taking a margin pressure into account to control pump flow rates to be supplied to the circuit based on the calculated value (For example, refer to Patent Document 1). Although, when a large load is applied on the cylinder, and an engine revolution speed drops below that at which an engine can output horsepower most efficiently, an electronic control system controls to reduce the pump flow rate and to maintain the engine revolution speed, whatever the case may be, through a flow rate control mainly with the load sensing circuit, the engine is operated to activate a target actuator by a fixed lever stroke without stalling regardless of the load.

By the way, in some working machines, a regeneration circuit for returning hydraulic fluid from a rod side of a boom cylinder to a head side thereof is used in order to achieve an increase in actuator speeds and a saving in pump flow rates when a boom is being laid down (For example, refer to the Patent Document 2). In this regeneration circuit, when a cylinder head pressure is higher than a rod pressure while the cylinder is moving in its contracting direction, a regeneration to return the hydraulic fluid from the head side to the rod side is performed, the cylinder contracting movement comes close to its end, and the regeneration is complete when the rod pressure becomes higher than the head pressure.

Patent Document 1: Japanese Utility Model Application Laid-open No. 6-84005 (Paragraphs 0001, 0002, FIGS. 2 and 3)

Patent Document 2: Japanese Patent Application Laid-Open 2006-9888 (Paragraph 0002)

DISCLOSURE OF THE INVENTION

Problem to be Solved by the Invention

Therefore, if the regeneration circuit is applied to a working machine in which the load sensing circuit is disposed, a proper pump flow rate control in response to a cylinder load can be achieved, theoretically, and in addition, with the result that, increase in actuator speeds and saving in pump flow rates when laying down a boom can be fulfilled.

However, if it is attempted to make both circuits to exist together as an actual hydraulic circuit, a proper load sensing control can not be performed, which will be described with reference to FIG. 3 showing an example in which both circuits exist together. In a control of the load sensing circuit, a swash plate of a pump 2 is controlled mainly based on a hydraulic pressure value between a boom cylinder 1 and a main valve 3 (In the figure, A is a detection point, and a hydraulic pressure value at the point is sent to the pump 2), and consequently when a regeneration is performed, it results in causing a difference by the regenerated oil part (recycle part) from a hydraulic pressure value of a main valve side. As a result, while the difference remains to be caused, it follows that a cylinder load will be calculated, and thus unnecessary flow rate (a volume without considering a regenerated oil part) will be discharged from the pump 2.

As a result, a proper control of cylinder pressure that constitutes an inherent intention of the load sensing can neither be achieved, nor can be obtained effectiveness of saving in pump flow rates that is an intention of the regeneration circuit.

The present invention was devised in view of the problems as above described, and is intended to provide a technology that can utilize the advantages of both the load sensing control and the regeneration circuit without causing any problem.

Means for Solving Problems

For this reason, a method for controlling a pump in a hydraulic circuit in which a regeneration circuit is added to a hydraulic circuit provided with a hydraulic pressure signal line for detecting a hydraulic pressure value of a circuit and controlling a volume of hydraulic fluid to a cylinder with reference to the detected value; the method comprising the steps of: in the middle of the hydraulic pressure signal line, disposing a pressure reducing and outputting means for reducing a hydraulic pressure value of the detected value to output the reduced hydraulic pressure value to a pump as an operating signal; and outputting the reduced hydraulic pressure value from the pressure reducing and outputting means by a controlling means to reduce a discharge rate from the pump, when the regeneration circuit is in a regeneration state.

Here, the present invention is adapted to detect a hydraulic pressure value of a circuit, and to control a volume of hydraulic fluid to a cylinder with reference to the detected value; this is a hydraulic fluid flow rate control in a so called load sensing circuit. That is, the present invention is predicated on a hydraulic circuit in which a regeneration circuit is added to the so-called load sensing circuit. In addition, the regeneration circuit refers to just as described in the prior art. Further, the regeneration circuit being in a regeneration state refers to a state where regenerated oil flows through the regeneration circuit; for example, in the case of the regeneration circuit of the boom cylinder, it refers to a state where hydraulic fluid at a cylinder head side flows through the regeneration circuit into a rod side.

The pressure reducing and outputting means may be a pressure reducing means that can reduce the detected hydraulic pressure value and output the reduced values to the pump as an operating signal, and may include a pressure reducing valve, a relief valve, other pressure regulators, etc.

Effect of the Invention

According to the present invention, a load sensing circuit and a regeneration circuit can be allowed to exist together without any problem. That is, if in normal state, while a pump discharge flow rate is controlled by a so-called load sensing circuit; when the regeneration circuit is in a regeneration state, a hydraulic pressure value that has been reduced by a pressure reducing and outputting means is output by a controlling means to a pump therefrom as an operating command, thereby reducing the oil volume of the regenerated oil part and controlling the pump flow rate. Therefore, effectiveness of a proper control of cylinder pressures by the load sensing circuit, increase in an actuator operating speed by the regeneration circuit, and improvement in fuel consumption through reduction in a pump discharge flow rate, will be obtained in one circuit.

REFERENCE NUMERALS

Figure 1:
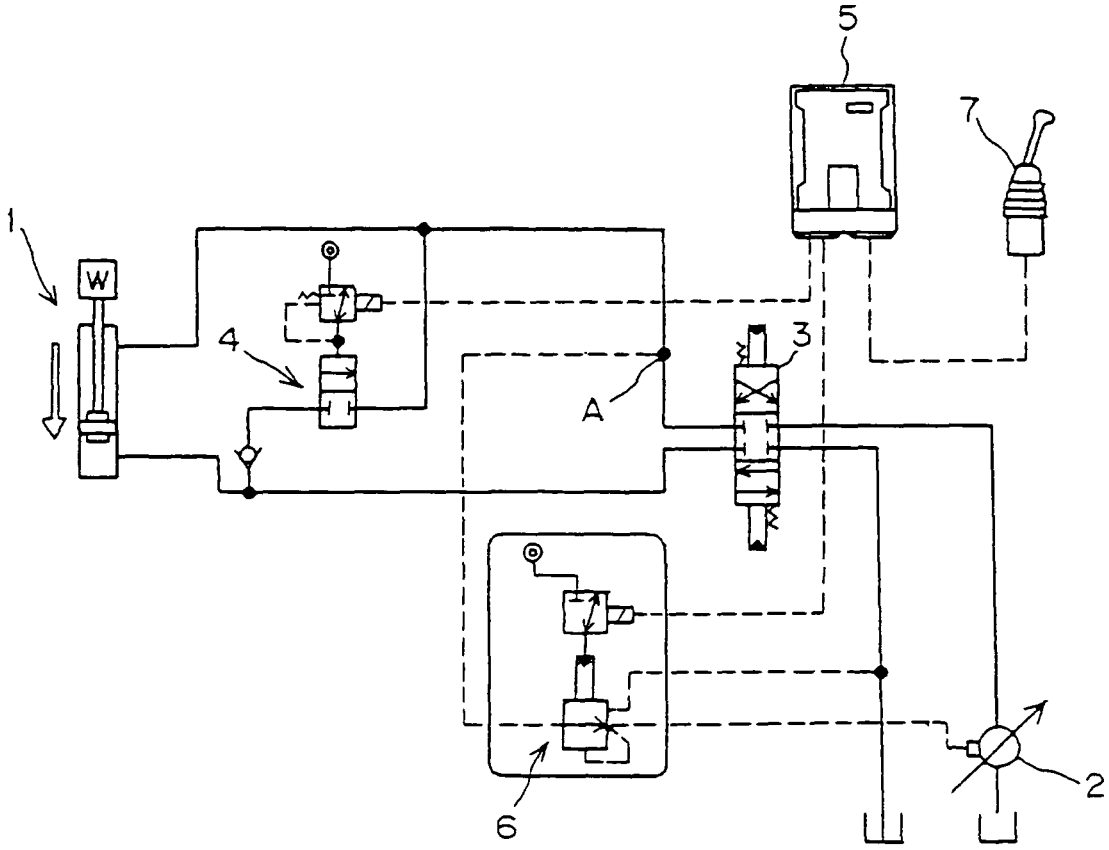
FIG. 1 is a circuit diagram of a first embodiment according to the present invention.

1 Boom cylinder
2 Main pump
3 Main control valve
4 Regulating Valve for regeneration
5 Controller (controlling means)
6 Pressure reducing valve
7 Operating lever
8 Relief valve
9 Electromagnetic switching valve
10 Orifice

DESCRIPTION OF THE PREFERRED EMBODIMENT

A first embodiment that is a specific embodiment according to the present invention will be described with reference to FIG. 1. Any of the embodiments to be described below is an example where the present invention is applied for hydraulic circuit associated with a boom of a hydraulic excavator. Incidentally, it is a matter of course that the present invention is not limited to the under-mentioned embodiments (including a second embodiment), the present invention may be applied for a hydraulic circuit associated with, for example, arm and bucket of the hydraulic excavator, and my be applied for any given hydraulic circuit for other working machines.

In the figure, reference numeral 1 denotes a boom cylinder, 2; a main pump, 3; a main control valve, 4; a regulating valve for regeneration, 5; a controller acting as a controlling means, and 6; a pressure reducing valve.

First, a circuit of the present embodiment is predicated on a load sensing circuit. That is, a hydraulic pressure value detection point A is provided in the circuit, and a hydraulic pressure signal line is formed (a pressure reducing valve 6 intervenes in the middle of the line, which will be described later) from the detection point A to the main pump 2. In the main pump 2, a swash plate is controlled in accordance with a signal from the signal line, and the discharge rate thereof is controlled. In this manner, a load sensing circuit is formed, in which a detection value from the hydraulic pressure value detection point A acts as an operating signal of the pump 2 discharge rate control.

Next, in a circuit of the present embodiment, a regulating valve 4 for regeneration is disposed between the boom cylinder 1 and the main control valve 3. The circuit is composed of the valve 4, plus a check valve. This circuit is operated to constitute the so-called regeneration circuit, in which, when a pressure at a head side of the boom cylinder 1 is higher than that at a rod side, hydraulic fluid flows from a cylinder head side to the rod side. Thereby, when a boom (not shown) is in laid-down state, hydraulic fluid is made to flow from the regeneration circuit into the rod side, while a pressure at the head side is higher than that at the rod side, thus achieving an increase in boom down speed, and saving in hydraulic fluid.

Also, when a hydraulic fluid is flowing through the regeneration circuit, a signal that indicates the regeneration state thereof is output from the regulating valve 4 for regeneration to the controller 5. To the controller 5, a positional signal is also input from an operating lever 7. An assumed pressure (including margin pressure) of the boom cylinder 1 corresponding to the positional signal has been set on a table.

In such a configuration, a feature of the present embodiment is in that the pressure reducing valve 6 acting as a pressure reducing and outputting means is disposed in the circuit. The pressure reducing valve 6 is disposed in the middle of the hydraulic pressure signal line formed from the hydraulic pressure detection value point A, and in the case of being in a regenerated state, it controls so as to reduce hydraulic pressure values detected at A by the use of a orifice. This orifice control is performed in accordance with a command of the controller 5, the command of the controller 5 is output by receiving a signal that indicates a regenerated state from the regulating valve 4 for regeneration. The reduced volume, that is, the restricted volume, is the one to which a regenerated oil volume has been considered, and the value thereof is calculated and set beforehand in the table of the controller 5. Therefore, the controller 5 extracts a corresponding restricted volume from the table from a positional signal of the operating lever 7 and a signal that indicates a regenerated state, and outputs a restricted volume to the pressure reducing valve 6 as a reduction command signal.

When the pressure reducing valve 6 receives the reduction command signal from the controller 5, the detected hydraulic pressure value is decreased by the orifice, and it will be sent to the main pump 2 as a load sensing pressure. As described above, the load sensing pressure serves as an operating signal for a discharge pressure control of the main pump 2. As a result, when in a regenerated state, the pressure reducing valve 6 outputs a pressure reducing command signal to the main pump 2. In the main pump 2 that has received the pressure serving as an operating signal of the reduced pressure from the reducing valve 6, a swash plate is controlled based on the pressure, and the volume after subtracting the regenerated oil volume is discharged as a discharge pressure.

As described above, in the present embodiment, if in normal state, not in regeneration state, a normal load sensing control is performed, and when such a state takes place where a regeneration of hydraulic fluid is performed, like when laying down the boom, a reduced pump flow rate in consideration of hydraulic fluid of recycle part for regeneration is controlled.

Accordingly, in the present embodiment, while, in normal state, a proper flow rate control of the pump 2 is performed by a load sensing control; in regeneration state, a control is performed in such a manner that increase in operating speeds of a boom cylinder 1 by the use of the regeneration circuit, and improvement in fuel consumption by virtue of the reduction in pump flow rates can be achieved.

Further, as an apparatus configuration, all that is needed is only combining existing load sensing circuit and the regeneration circuit, and subsequently adding the pressure reducing valve 6, and then commanding the control thereof using the controller 5. Accordingly, a feasible embodiment is configured without the need to add substantial modification to existing circuit, thus requiring also inexpensive costs.

Figure 2:
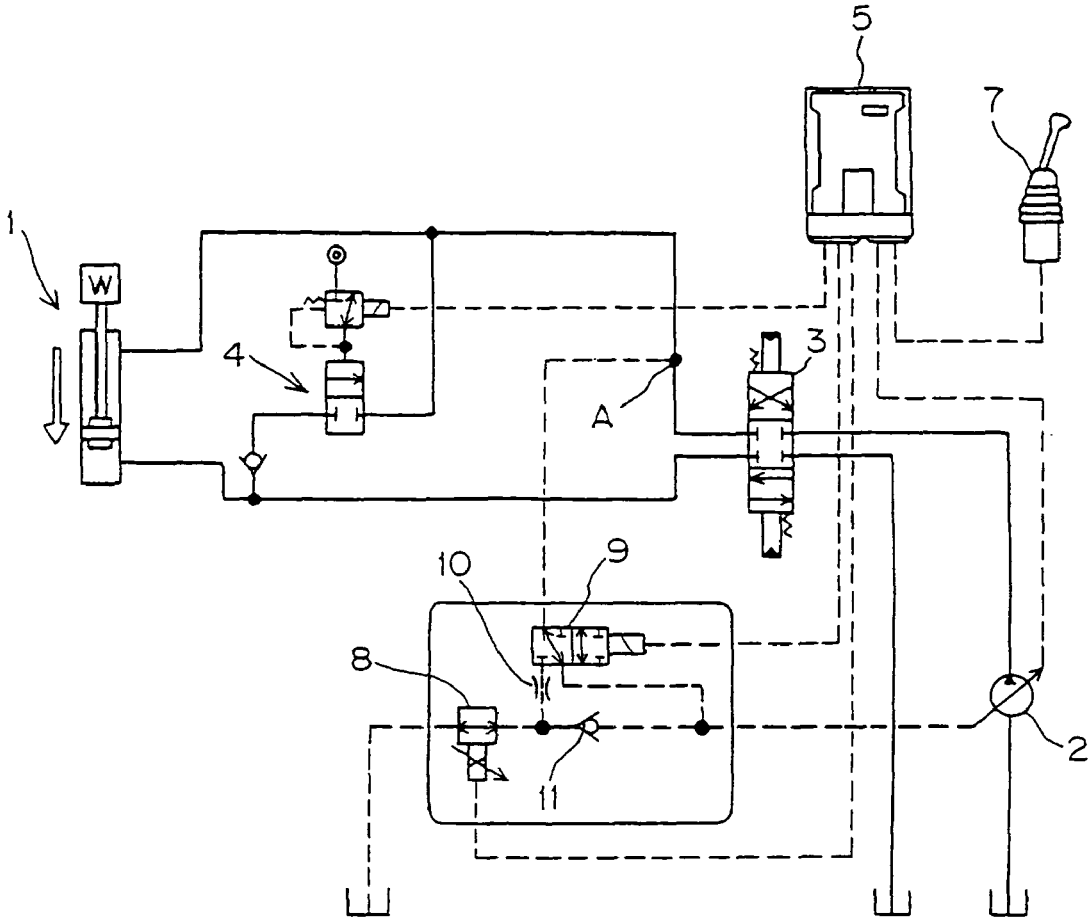
FIG. 2 is a circuit diagram of a second embodiment according to the present invention.
Figure 3:
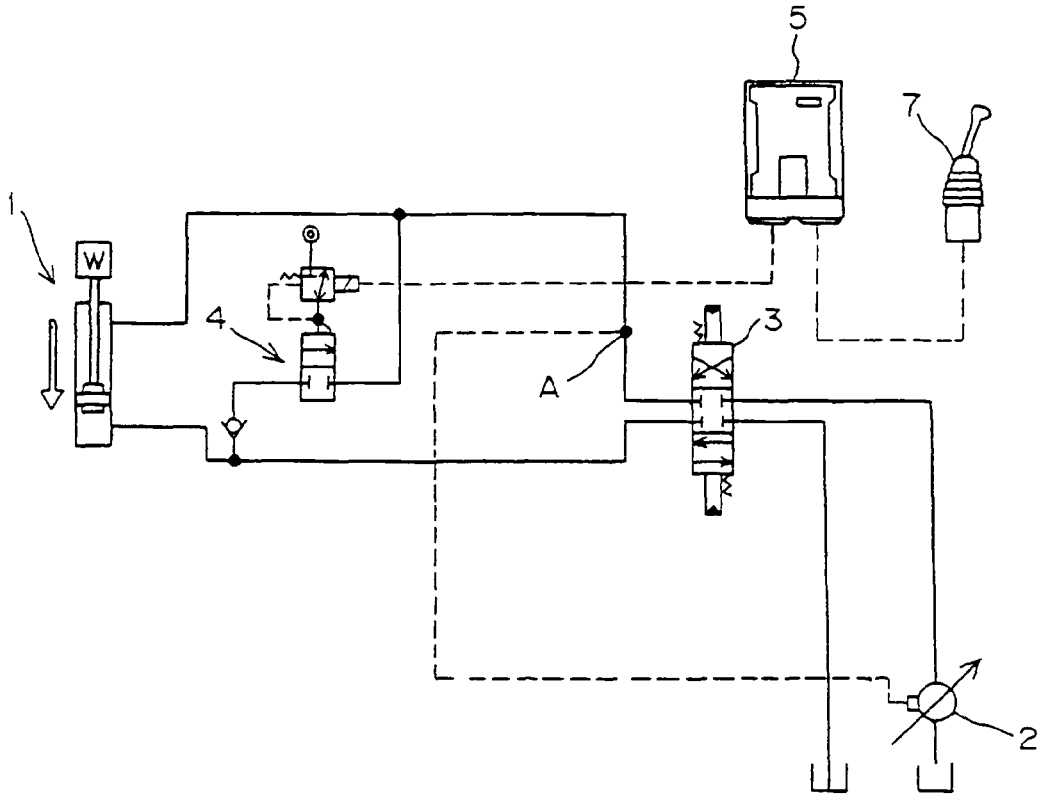
FIG. 3 is a circuit diagram of a configuration where a regeneration circuit is added to a load sensing circuit.

Next, a second embodiment that is another embodiment of the present invention will be described referring to FIG. 2. The present embodiment example has substantially the same configuration as that of the above first embodiment (since reference numerals for common configuration are identical with each other, their descriptions will be omitted), but only the configuration of the pressure reducing and outputting means is different therefrom.

That is, a relief valve 8 is used for the pressure reducing and outputting means of the present embodiment, and it is configured to cause the relief valve 8 to reduce a hydraulic pressure value of the hydraulic pressure signal line. Also, in the present embodiment, an electromagnetic switching valve 9 is disposed upstream of the relief valve 8, and in normal state (in non-regeneration state) while a detection value of A is directly output to a pump by way of a switching control of the controller 5; in regeneration state, it is output at the relief valve 8 side. In a line running toward the relief valve 8, an orifice 10 is formed for causing no effect on a primary pressure, as well as a reduced hydraulic pressure value is output from the relief valve 8 through a check valve 11 to a pump 2. Here, if a solenoid of reverse proportional type is used as the relief valve 8, the check valve 11 needs not to be especially disposed, in the case of this embodiment, the reduced hydraulic pressure values from the relief valve 8 are output as they are to the pump 2. Whatever the case may be, a pressure reducing regulation of the relief valve 8 is performed in the same manner as the first embodiment, based on a table set on the controller 5. Thereby, in regeneration state, a reduced pressure value from the relief valve 8 in consideration of the regenerated oil part is output to the pump 2 as an operating signal, and then a reduced flow rate control is performed from the pump 2 based on the operating signal.

Therefore, also in the present embodiment, in normal state, while a proper flow rate control of the pump 2 is performed through the load sensing control; in regeneration state, a control is performed in such a manner that increase in operating speeds of the boom cylinder 1 by the use of the regeneration circuit, and improvement in fuel consumption by virtue of reduction in pump flow rates can be achieved. It is a matter of course that, as with the first embodiment, a feasible embodiment is configured without the need to add substantial modification to existing circuit, resulting in requiring inexpensive costs.

INDUSTRIAL APPLICABILITY

The present invention is applicable as a hydraulic circuit for working machine.

The invention claimed is:

1. A method for controlling a pump in a hydraulic circuit in which a regeneration circuit is added to a hydraulic circuit provided with a hydraulic pressure signal line for detecting a hydraulic pressure value of a circuit and controlling a volume of hydraulic fluid to a cylinder with reference to the detected value; said method comprising the steps of:

in the middle of said hydraulic pressure signal line, disposing a pressure reducing and outputting means for reducing a hydraulic pressure value of said detected value to output the reduced hydraulic pressure value to a pump as an operating signal; and outputting the reduced hydraulic pressure value from said pressure reducing and outputting means by a controlling means to reduce a discharge rate from the pump, when said regeneration circuit is in a regeneration state, in which said pressure reducing and outputting means comprises a pressure reducing valve for reducing said detected hydraulic pressure value by the use of an orifice and outputting the hydraulic pressure value to a pump, upon receiving a pressure reducing command signal from a controller as said controlling means.

2. A method for controlling a pump in a hydraulic circuit in which a regeneration circuit is added to a hydraulic circuit provided with a hydraulic pressure signal line for detecting a hydraulic pressure value of a circuit and controlling a volume of hydraulic fluid to a cylinder with reference to the detected value; said method comprising the steps of:

in the middle of said hydraulic pressure signal line, disposing a pressure reducing and outputting means for reducing a hydraulic pressure value of said detected value to output the reduced hydraulic pressure value to a pump as an operating signal; and outputting the reduced hydraulic pressure value from said pressure reducing and outputting means by a controlling means to reduce a discharge rate from the pump, when said regeneration circuit is in a regeneration state, in which said pressure reducing and outputting means comprises a relief valve having an electromagnetic switching valve on its upstream side, and switching of the electromagnetic switching valve, by a controller as said controlling means through direct outputting of said detected value to a pump when said regeneration circuit is in a non-regeneration state, and of first outputting of said detected value to the relief valve followed by outputting of the reduced hydraulic pressure value from said relief valve to a pump when said regeneration circuit is in a regeneration state.

* * * * *